US012618561B1

(12) United States Patent
Ols et al.

(10) Patent No.: US 12,618,561 B1
(45) Date of Patent: May 5, 2026

(54) COMBUSTION LINER HAVING COOLING HOLES WITH STEPPED LATERAL SIDEWALLS

(71) Applicant: RTX Corporation, Farmington, CT (US)

(72) Inventors: John Ols, Northborough, MA (US); Mary Gurak, Glastonbury, CT (US); Judith Brooks, Palo Alto, CA (US); Deanna Jindal, Phillipsburg, NJ (US); Roger Coffey, Glastonbury, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 19/055,286

(22) Filed: Feb. 17, 2025

(51) Int. Cl.
*F23R 3/00* (2006.01)
*B24C 1/04* (2006.01)

(52) U.S. Cl.
CPC ..... *F23R 3/002* (2013.01); *B24C 1/045* (2013.01); *F23R 2900/00018* (2013.01); *F23R 2900/03041* (2013.01)

(58) Field of Classification Search
CPC ..... F23R 3/002; F23R 2900/00018; F23R 2900/03041; B24C 1/045; F01D 5/186
See application file for complete search history.

(56) References Cited

U.S. PATENT DOCUMENTS 6,234,755 B1 * 5/2001 Bunker ..... F01D 25/12 416/97 R
6,383,602 B1 5/2002 Fric et al.
6,573,474 B1 6/2003 Loringer
6,667,076 B2 12/2003 Fried et al.
7,246,999 B2 7/2007 Manning et al.
10,500,678 B2 12/2019 Dong et al.
11,708,762 B2 7/2023 Ikehara et al.
11,752,573 B2 9/2023 Reed et al.
2006/0196188 A1 9/2006 Burd et al.
2014/0248425 A1 9/2014 Patterson et al.
(Continued)

FOREIGN PATENT DOCUMENTS

KR 102509212 B1 3/2023

OTHER PUBLICATIONS

Non-Final Office Action dated Jul. 22, 2025, for corresponding U.S. Appl. No. 19/055,299, 30 pgs.
(Continued)

*Primary Examiner* — Rodolphe Andre Chabreyrie
(74) *Attorney, Agent, or Firm* — Kinney & Lange, P.A.

(57) ABSTRACT

Apparatus and associated methods relate to geometry of cooling holes in a combustion liner for a gas turbine engine. The combustion liner includes a base-alloy substrate having a bottom surface and a top surface, a thermal barrier coat (TBC) metallic layer on the top surface of the base-alloy structure, and a TBC ceramic layer on the TBC metallic layer. The cooling holes are formed at oblique angles to the top surface of the TBC ceramic layer, thereby forming oval-characteristic exit apertures at the top surface of the TBC ceramic layer. The oval-characteristic exit apertures define a long axis and a short axis. The long axis extends between an upstream side and a downstream side and the short axis extends between opposite lateral sides, thereby defining opposite lateral sidewalls, which have stepped sidewall profiles, in the cooling holes.

20 Claims, 7 Drawing Sheets

(56) References Cited

U.S. PATENT DOCUMENTS

| | | | | |
|---|---|---|---|---|
| 2017/0261208 | A1* | 9/2017 | Starkweather | B23K 26/389 |
| 2019/0039177 | A1 | 2/2019 | Reed et al. | |
| 2023/0050204 | A1* | 2/2023 | Craig | F01D 25/12 |
| 2024/0102392 | A1 | 3/2024 | Wang et al. | |
| 2024/0293892 | A1 | 9/2024 | Craig et al. | |

OTHER PUBLICATIONS

Non-Final Office Action dated Jun. 12, 2025, for corresponding U.S. Appl. No. 19/055,286, 26 pgs.

* cited by examiner

COMBUSTION LINER HAVING COOLING HOLES WITH STEPPED LATERAL SIDEWALLS

BACKGROUND

Gas turbine engines can operate at very high temperatures for long periods of time. Various components of gas turbine engines can be exposed to very hot gases, such as the gases produced in the combustion chamber of gas turbine engines. These products of combustion provide high thermal exposure to various components, such as, for example, combustion liners, turbine blades, and nozzle guide vanes. Insufficient cooling of these components can result in local thermal cracks and can reduce the strength of the components' materials. Various cooling technologies can be used to protect these components, so as to extend the life of these components. To protect surfaces of these components from exposure to temperatures higher than the component's safe thermal-exposure specification, a secondary flow can be introduced by means of holes over surfaces resulting in formation of a film of cooling air flowing thereover. This film of cooling air operates as a protection layer between high temperature gases and the components' surfaces. Such a cooling technique is called effusion cooling or film cooling.

SUMMARY

Some embodiments are related to a combustion liner with a plurality of cooling holes. The combustion liner includes a base-alloy substrate having a bottom surface and a top surface, a thermal barrier coat (TBC) metallic layer on the top surface of the base-alloy structure, and a TBC ceramic layer on the TBC metallic layer. The TBC ceramic layer has a top surface configured to be exposed to combustion gases during operation within a gas turbine engine. The plurality of cooling holes is formed, each through the combustion liner extending from an entrance aperture at the bottom surface of the base-alloy structure and an exit aperture at the top surface of the TBC ceramic layer. Each of the plurality of cooling holes is formed at an oblique angle to the top surface of the TBC ceramic layer, thereby forming an oval-characteristic exit aperture at the top surface of the TBC ceramic layer. Each of the oval-characteristic exit apertures defines a long axis and a short axis. The long axis extends between an upstream side and a downstream side and the short axis extends between opposite lateral sides, thereby defining opposite lateral sidewalls in each of the base-alloy substrate, the TBC metallic layer, and the TBC ceramic layer. Each of the cooling holes has a stepped sidewall profile at each of the opposite lateral sidewalls. A first distance between the opposite lateral sidewall of the TBC ceramic layer is greater than a second distance between the opposite lateral sidewalls of the TBC metallic layer.

Some embodiments relate to a method for creating a combustion liner. In the method, a base-alloy substrate having a bottom surface and a top surface is provided. A thermal barrier coat (TBC) metallic layer is deposited on the top surface of the base-alloy structure. A TBC ceramic layer is deposited on the TBC metallic layer. The TBC ceramic layer has a top surface configured to be exposed to combustion gases during operation within a gas turbine engine. A plurality of cooling holes is formed through the combustion liner, each extending from an entrance aperture at the bottom surface of the base-alloy structure and an exit aperture at the top surface of the TBC ceramic layer. Each of the plurality of cooling holes is formed at an oblique angles to the top surface of the TBC ceramic layer, thereby forming an oval-characteristic exit aperture at the top surface of the TBC ceramic layer. Each of the oval-characteristic exit apertures defines a long axis and a short axis. The long axis extends between an upstream side and a downstream side, and the short axis extends between opposite lateral sides, thereby defining opposite lateral sidewalls in each of the base-alloy substrate, the TBC metallic layer, and the TBC ceramic layer. Each of the cooling holes has a stepped sidewall profile at each of the opposite lateral sidewalls. A first distance between the opposite lateral sidewalls of the TBC ceramic layer is greater than a second distance between the opposite lateral sidewalls of the TBC metallic layer.

BRIEF DESCRIPTION OF THE DRAWINGS

The material described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. In the figures.

DETAILED DESCRIPTION

Apparatus and associated methods relate to geometry of cooling holes in a combustion liner for a gas turbine engine. The combustion liner includes a base-alloy substrate having a bottom surface and a top surface, a thermal barrier coat (TBC) metallic layer on the top surface of the base-alloy structure, and a TBC ceramic layer on the TBC metallic layer. The cooling holes are formed at oblique angles to the top surface of the TBC ceramic layer, thereby forming oval-characteristic exit apertures at the top surface of the TBC ceramic layer. The oval-characteristic exit apertures define a long axis and a short axis. The long axis extends between an upstream side and a downstream side and the short axis extends between opposite lateral sides, thereby defining opposite lateral sidewalls, which have stepped sidewall profiles, in the cooling holes.

Figure 1A:
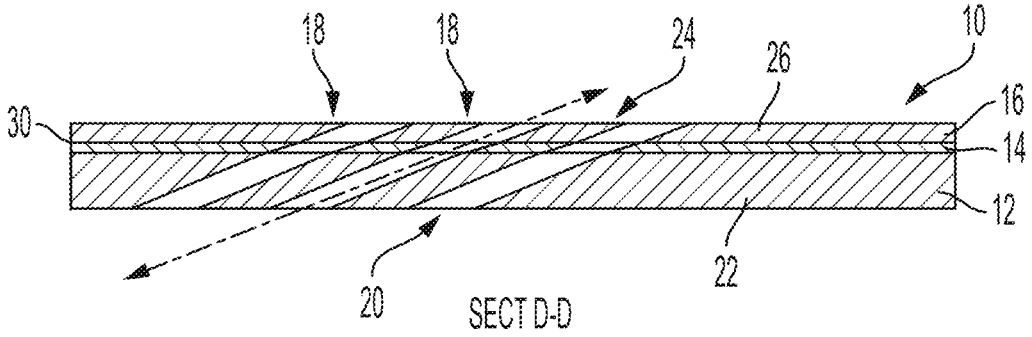
FIGS. 1A-1B are a longitudinal cross-sectional view of a region of a combustion liner and a plan view of the region of the combustion liner, respectively.
Figure 1B:
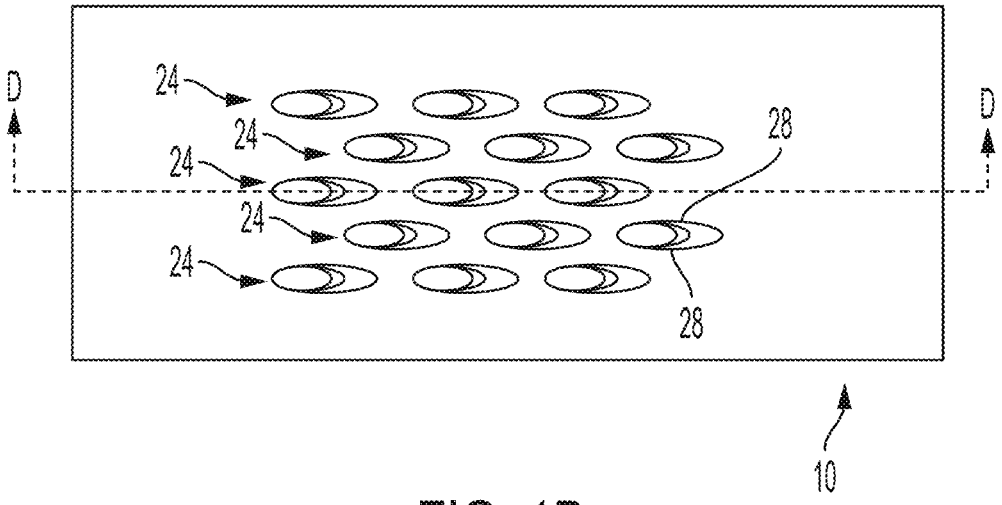

FIGS. 1A-1B are a longitudinal cross-sectional view of the region of a combustion liner and a plan view of a region of the combustion liner, respectively. In FIG. 1A, a portion of combustion liner 10 includes base-alloy substrate 12, thermal barrier coat (TBC) metallic layer 14, and TBC ceramic layer 16. Although the entire combustion liner is not depicted in FIGS. 1A and 1B, base-alloy substrate 12, is typically formed into a geometry appropriate for the combustion chamber of a gas turbine engine. TBC metallic layer 14 is formed upon on side of base-alloy substrate 12 on an interior facing side of the combustion liner. TBC ceramic layer 16 is then formed upon TBC metallic layer 14. Thus, TBC ceramic layer 16 is configured to be exposed to combustion gases within the combustion chamber of the gas turbine engine. Cooling holes 18 are formed through combustion liner 10, extending from entrance aperture 20 at bottom surface 22 of base-alloy structure 12 and exit aperture 24 at top surface 26 of TBC ceramic layer 16. Each of cooling holes 18 is formed at an oblique angles θ with respect to top surface 26 of TBC ceramic layer 16. The central axes A of cooling holes 18 are typically greater than 45° from a normal vector N of top surface 26 of TBC ceramic layer 16. Such obliquely angled cooling holes 18 facilitate flow of cooling air to be directed as a film layer immediately adjacent to top surface 26 of TBC ceramic layer 16. Such a film layer of cooling air creates a thermal buffer between the hot gases within the combustion chamber and TBC ceramic layer 16.

Figure 2:
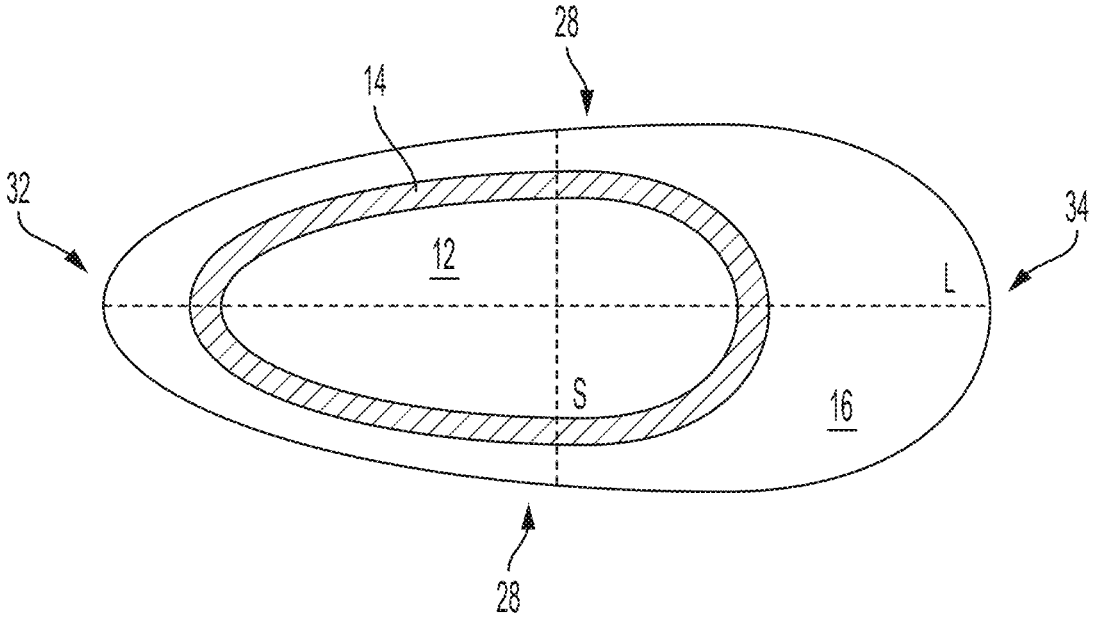
FIG. 2 is a plan view of a single cooling hole, depicting various layers of the combustion liner.

The portion of combustion liner 10 depicted in cross-sectional view in FIG. 1A is also depicted in plan view in FIG. 1B. Annotated in FIG. 1B is cross-sectional line D-D, through which the cross-section depicted in FIG. 1A is depicted. Cooling holes 18 form oval-characteristic exit apertures 24 at top surface 26 of TBC ceramic layer 16. Such oval-characteristic exit apertures 24 are a result of the oblique angle θ of cooling holes 18 with respect to central axes A. FIG. 2 is a plan view of a single cooling hole, depicting various layers of the combustion liner. In FIG. 2, base-alloy substrate 12, TBC metallic layer 14, and TBC ceramic layer 16 can be seen through exit aperture 24 of cooling hole 18. The oval-characteristic exit aperture 24 defines a long axis L and a short axis S. The long axis L extends between an upstream side and a downstream side of the exit aperture 24, thereby defining upstream and downstream sidewalls 32 and 34 in each of cooling holes 18. The short axis S extends between opposite lateral sides, thereby defining opposite lateral sidewalls 28 in each of cooling holes 18. As will be described in more detail below, these sidewalls (the upstream sidewall, the downstream sidewall and the opposite lateral sidewalls) have been created with profiles that facilitate formation of the film layer of cooling air.

Figure 3A:
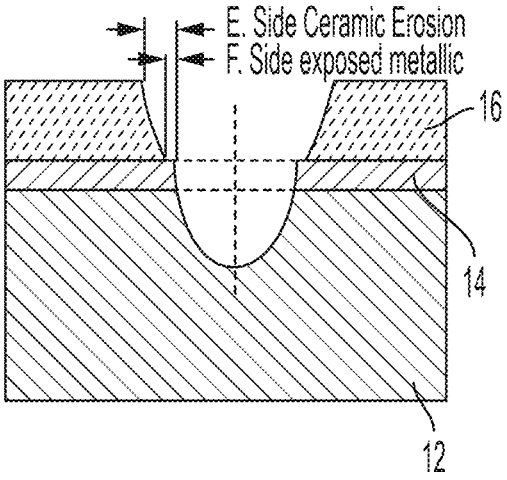
FIGS. 3A and 3B are lateral cross-sectional views of a cooling hole of the combustion liner.
Figure 3B:
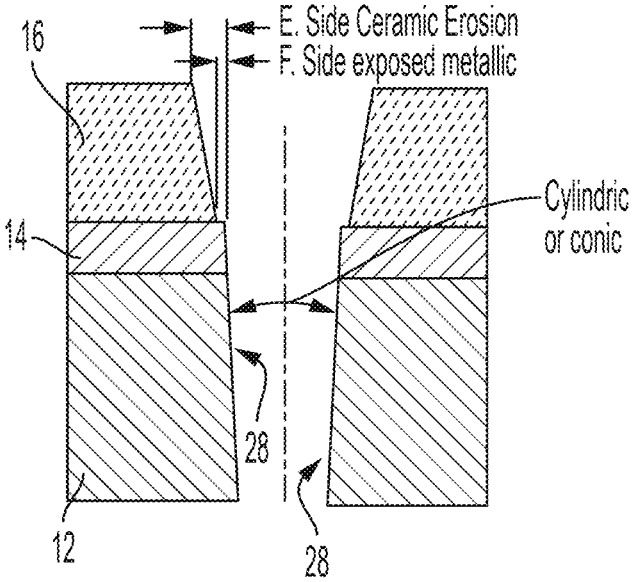

FIGS. 3A and 34B are lateral cross-sectional views of a cooling hole of the combustion liner. In FIG. 3A, cooling hole 18 is cross-sectioned vertically, with respect to top surface 26 of TBC ceramic layer 16. In FIG. 3B, cooling hole 18 is cross-sectioned obliquely, along axis A of cooling hole 18. Because of the oblique angle of the cross section, layers appear thicker in FIG. 3B than those same layers appear in FIG. 3A. In FIGS. 3A and 3B, cooling hole 18 extends from bottom surface 22 of base-alloy structure 12 and to top surface 26 of TBC ceramic layer 16, thereby traversing through each of base-alloy substrate 12, TBC metallic layer 14, and TBC ceramic layer 16. Although TBC metallic layer 14 is thin, as compared with thicknesses of base-alloy substrate 12 and TBC ceramic layer 16, TBC metallic layer 14 can be readily seen from above exit aperture 24, as TBC ceramic layer 16 is recessed away from central axis A with respect to TBC metallic layer 14, thereby exposing a metallic ledge of a top surface of TBC metallic layer 14. A distance (i.e., a lateral ledge width), as measured in the direction of the short axis S, of the exposed surface of the TBC metallic layer 14 (i.e., a distance between each of opposite lateral sidewalls 28 of the TBC metallic layer 14 and the corresponding lateral sidewall 28 of TBC ceramic layer 16 proximate TBC interface 30) can be between 5% and 40%, or between 10% and 30%, of a distance between the opposite lateral sidewalls 28 of TBC metallic layer 14.

This recessing of TBC ceramic layer 16 away from central axis A with respect to TBC metallic layer 14 results in a stepped sidewall profile for each of opposite lateral sidewalls 28 of TBC ceramic layer 16 at TBC interface 30. Cooling hole 18 is substantially cylindrical through the combined layers of base-alloy substrate 12 and TBC metallic layer 14. Cooling hole 18 has a stepped expansion at TBC interface 30 between TBC metallic layer 14 and TBC ceramic layer 16. Cooling hole 18 then monotonically increases in lateral dimension as cooling hole 18 traverses from TBC interface 30 to top surface 26 of TBC ceramic layer 16. In the depicted embodiment, the opposite lateral sidewall profile of TBC ceramic layer 16 is bell shaped (i.e., opposite lateral sidewalls 28 are inwardly concave or outwardly convex). In other embodiments, the opposite lateral sidewall profile of TBC ceramic layer 16 can be made to be conic shaped (i.e., with straight angled opposite lateral sidewalls 28) or horn shaped (i.e., opposite lateral sidewalls 28 are inwardly convex or outwardly concave). In all these embodiments, the distance between opposite lateral sidewalls 28 of TBC ceramic layer 16 is greater than the distance between opposite lateral sidewalls 28 of TBC metallic layer 14 and of base-alloy layer 12. A ratio of the distance between the opposite lateral sidewalls 28 of TBC ceramic layer 16, as measured proximate TBC interface 30, to the distance between opposite lateral sidewalls 28 of TBC metallic layer 14, can be greater than 1.1, greater than 1.2 or even greater than 1.3. Such a stepped opposite lateral sidewall profile facilitates the production of a film layer of cooling are above top surface 26 of TBC ceramic layer 16.

Figure 4:
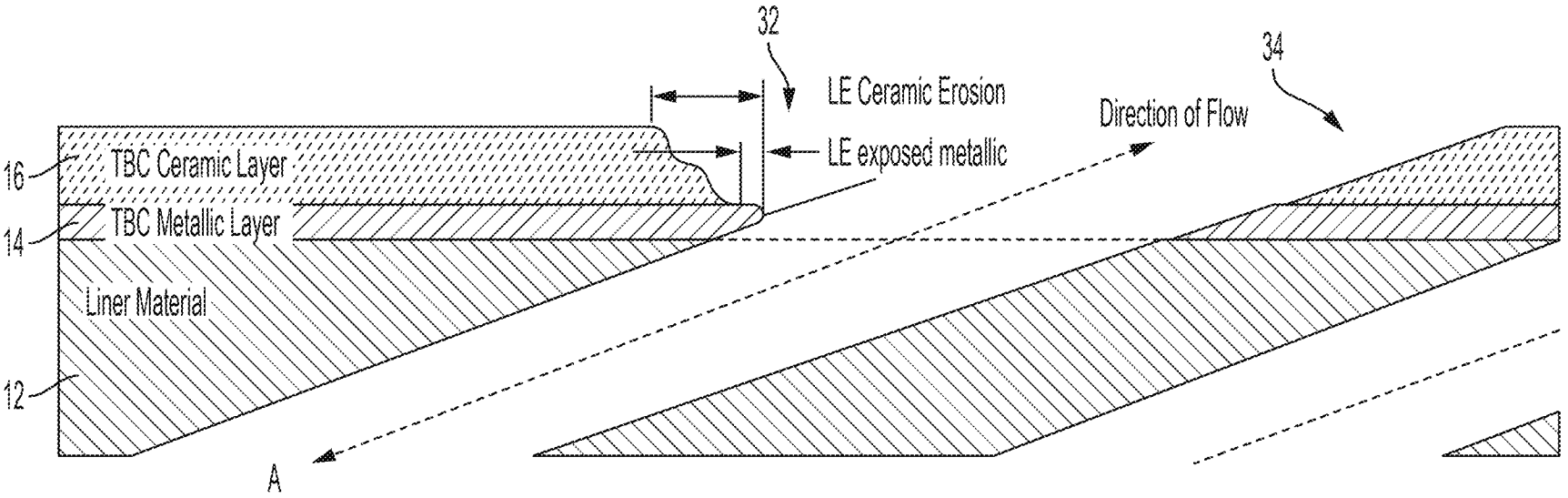
FIG. 4 is a longitudinal cross-sectional view of a cooling hole of the combustion liner.

FIG. 4 is a longitudinal cross-sectional view of a cooling hole of the combustion liner. In FIG. 4, cooling hole 18 extends from bottom surface 22 of base-alloy structure 12 and to top surface 26 of TBC ceramic layer 16, thereby traversing through each of base-alloy substrate 12, TBC metallic layer 14, and TBC ceramic layer 16. Although TBC metallic layer 14 is thin, as compared with thicknesses of base-alloy substrate 12 and TBC ceramic layer 16, TBC metallic layer 14 can be readily seen from above exit aperture 24, as TBC ceramic layer 16 is recessed away from central axis A with respect to TBC metallic layer 14, thereby exposing metallic ledge of a top surface of TBC metallic layer 14. A distance (i.e., an upstream ledge width), as measured in the direction of the long axis L, of the exposed surface of the TBC metallic layer 14 (i.e., a distance between upstream sidewall 32 of the TBC metallic layer 14 and the corresponding upstream sidewall 32 of TBC ceramic layer 16 proximate TBC interface 30) can be between 5% and 40%, or between 10% and 30%, of a distance between upstream sidewall 32 and downstream sidewall 34 of TBC metallic layer 14.

This recessing of TBC ceramic layer 16 away from central axis A with respect to TBC metallic layer 14 results in a stepped sidewall profile for each of upstream sidewall 32 and downstream sidewall 34, although it is much more pronounced in upstream sidewall 32. Again, from this cross-sectional perspective, cooling hole 18 is substantially cylindrical through the combined layers of base-alloy substrate 12 and TBC metallic layer 14. Cooling hole 18 has a stepped expansion at TBC interface 30 between TBC metallic layer 14 and TBC ceramic layer 16. Cooling hole 18 then monotonically increases in longitudinal dimension as cooling hole 18 traverses from TBC interface 30 to top surface 26 of TBC ceramic layer 16. In the depicted embodiment, the upstream sidewall profile of TBC ceramic layer 16 is a retrograde profile (i.e., upstream sidewall 32 is angled opposite the direction of cooling hole 18). Although depicted as unsmooth, in other embodiments, the upstream sidewall profile of TBC ceramic layer 16 can be made to be smooth (e.g., bell shaped, conic shaped, or horn shaped). A ratio of the distance between upstream sidewall 32 and downstream sidewall 34 of TBC ceramic layer 16, as measured the direction of the long axis L and proximate TBC interface 30, to the the distance between upstream sidewall 32 and downstream sidewall 34 of TBC metallic layer 14, can be greater than 1.03, greater than 1.1, or even greater than 1.2. Such stepped upstream and downstream sidewall profiles facilitate the production of a film layer of cooling are above top surface 26 of TBC ceramic layer 16.

Figure 5:
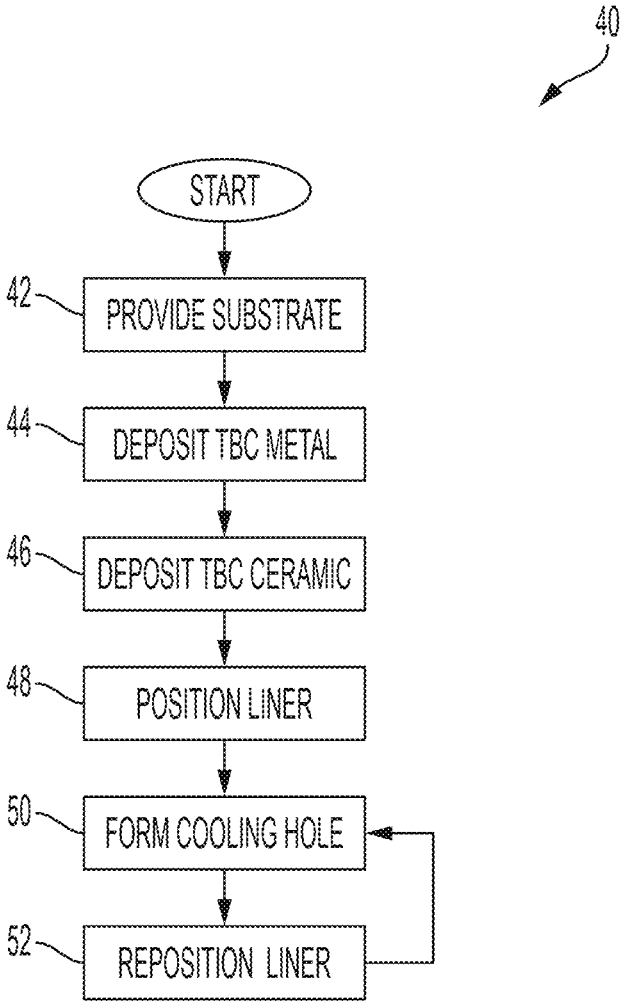
FIG. 5 is a flowchart for a method of producing holes in a combustion liner.

FIG. 5 is a flowchart of a method for creating a combustion liner. In FIG. 6, method 40 begins at step 42, where base-alloy substrate 12 having bottom surface 22 and a top surface is provided. Method 40 then advances to step 44, where TBC metallic layer 14 is deposited on top surface of base-alloy structure 12. Method 40 then advances to step 46, where TBC ceramic layer 16 is deposited on TBC metallic layer 14, thereby creating a combustion liner. TBC ceramic layer 16 has top surface 26, which is configured to be exposed to combustion gases during operation within a gas turbine engine. Method 40 then advances to step 48, where combustion liner 10, so produced, is positioned in relation to a water jet drilling system to form an oblique-angled cooling hole. Method 40 then advances to step 50, where the cooling hole is formed, via the water jet drilling system, through the combustion liner, extending from an entrance aperture at bottom surface 22 of base-alloy structure 12 and exit aperture 24 at top surface 26 of TBC ceramic layer 16. The water jet drilling system is configured to create the cooling hole with a stepped sidewall profile at each of opposite lateral sidewalls 28, such that a first distance between opposite lateral sidewalls 28 of TBC ceramic layer 16 is greater than a second distance between opposite lateral sidewalls 28 of base-alloy structure 12. Method 40 then advances to step 52, where combustion liner 10 is repositioned relative to the water jet drilling system for forming another cooling hole. In some embodiments, either combustion liner 10 or the water jet drilling system is repositioned or both. Method 40 then returns to step 50, where the next cooling hole is formed. The water jet drilling system can be configured to produce the desired sidewall profiles that facilitate production of a film layer of cooling air. The water jet drilling system can produce such profiled cooling holes without causing damage to the material remaining in base-alloy substrate 12, thermal barrier coat (TBC) metallic layer 14, and TBC ceramic layer 16.

Figure 6A:
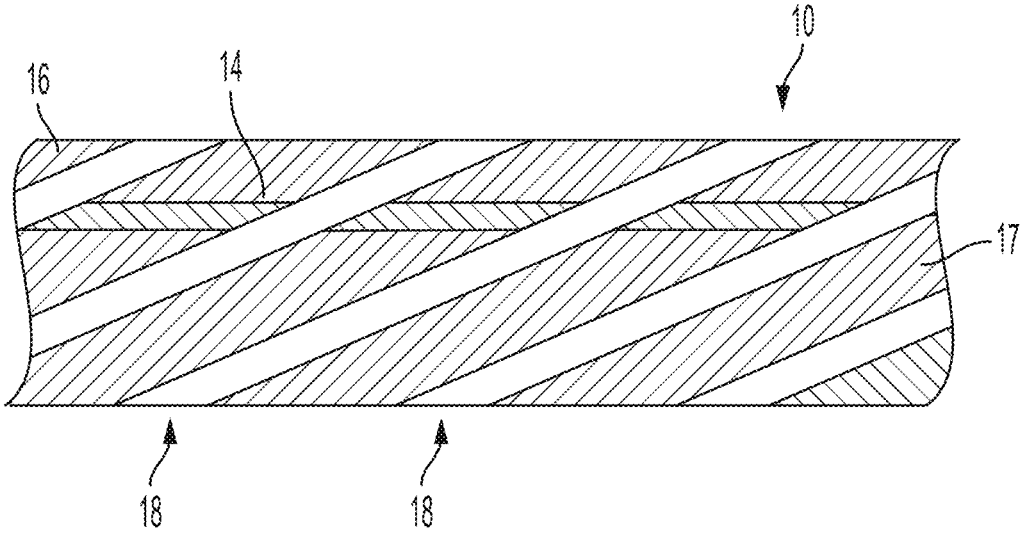
FIGS. 6A and 6B are a cross-sectional view and a plan view of a region of a combustion liner having a high-density of cooling holes formed therein.
Figure 6B:
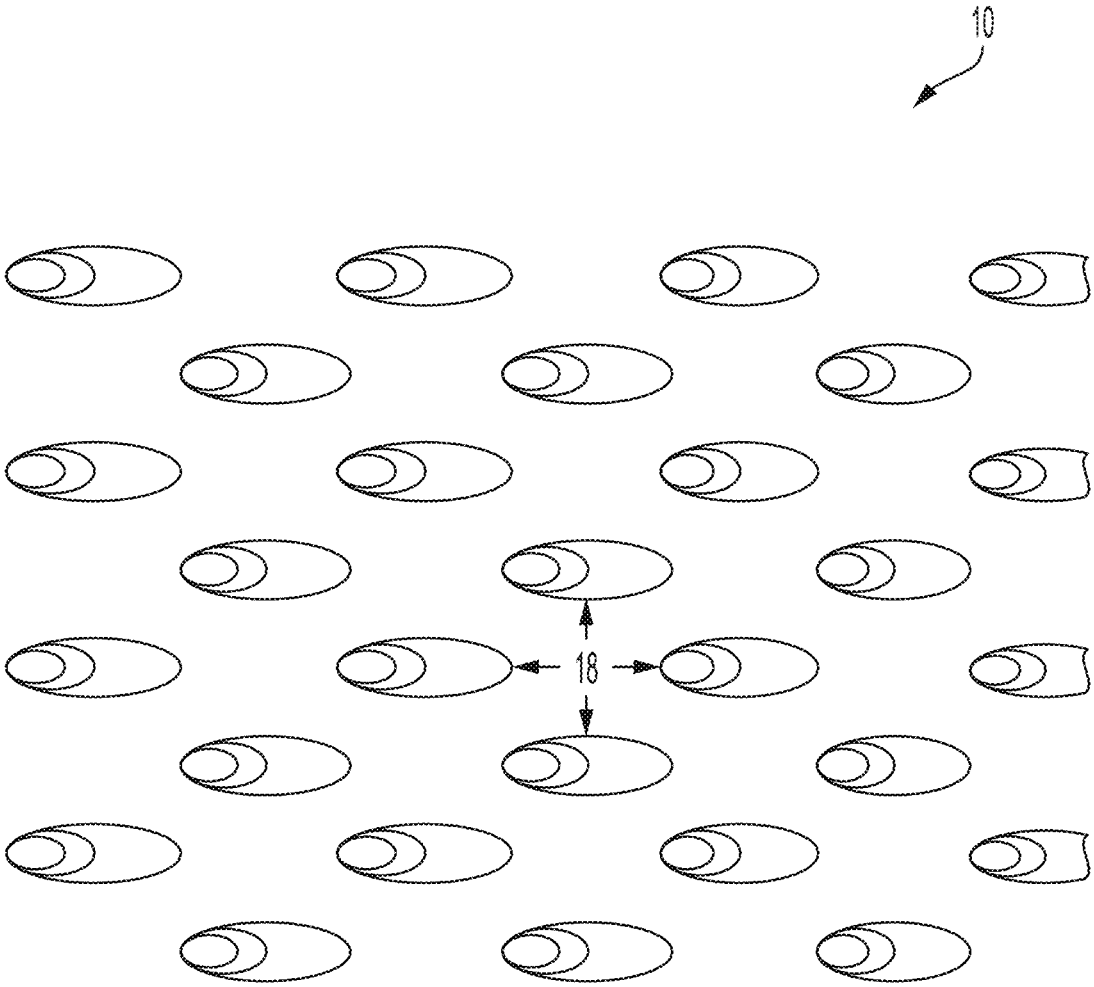

FIGS. 6A and 6B are a cross-sectional view and a plan view of a region of a combustion liner having a high-density of cooling holes formed therein. In FIGS. 6A and 6B, combustion liner 10 has a cooling holes 18 arranged in a close-pack configuration, in which surrounded by six nearest-neighbor cooling holes 18 about each cooling hole 18. Nearest-neighbor cooling holes 18 are radially distributed about each cooling hole 18. By using a water-jet drilling system to form the holes, little, if any, damage is imparted to the base-alloy substrate 12, thermal barrier coat (TBC) metallic layer 14, and TBC ceramic layer 16. As such, cooling holes 18 can be drilled in a higher hole density than can be obtained in traditional combustion liners. Such density can be measured in various manners. For example, a distance between adjacent nearest neighbor cooling holes, a ratio of the hole diameter to the distance between nearest neighbors, and/or a ratio of volume of the hole to a total volume of the region of combustion liner can be used as metrics of hole density.

To measure a ratio of a combined hole volume of the plurality of cooling holes to the volume of the region of the combustion liner to which the plurality of cooling holes belong, an area is determined, and the volume of holes therein is determined. For example, the hole volume $V_{HOLE}$ is given by:

$$V_{HOLE}=l\pi r^2, \tag{1}$$

where r is the radius of the hole and l is the distance of the hole through the combustion liner. For such a close-pack configuration, the volume $V_{LINER}$ of the combustion liner associated with only one hole is given by:

$$V_{LINER} = l\frac{\sqrt{3}}{2}s^2, \tag{2}$$

where s is the center-to-center spacing, as measured orthogonal to the axes A of the cooling holes, between adjacent cooling holes. A ratio $V_{HOLE}/V_{LINER}$ of these volumes—the volume of a single cooling hole to a volume of the associated cooling liner (which includes the cooling hole and its volume is given by:

$$\frac{2\pi}{\sqrt{3}}\cdot\left(\frac{r}{s}\right)^2. \tag{3}$$

For a cooling hole with a diameter of 0.011 inches, and a separation distance between adjacent colling holes of 0.05 inches, the ratio $V_{HOLE}/V_{LINER}$ of the volume of a cooling hole volume to the volume of the associated region of the combustion liner is given by:

$$\frac{V_{HOLE}}{V_{LINER}} \approx 0.176. \tag{4}$$

Such a ratio can be increased using water-jet drilling techniques. For example, ratios $V_{HOLE}/V_{LINER}$ of greater than 0.20, 025, and 0.30 can be obtained, while maintaining structural integrity of combustion liner 10.

As indicated in equation (2) above, a ratio of the radius (or diameter) of the cooling hole to separation spacing between cooling holes is also a metric of hole density. A ratio of the radius of each of the plurality of cooling holes to a center-to-center spacing between adjacent cooling holes, as measured in a direction perpendicular to the central axes, can be made to be greater than 0.20, 0.25, and 0.30. To realize such high ratios, the center-to-center spacing of adjacent cooling holes can be less than 0.028, 0.024, 0.020, or 0.016 inches. Such high densities of cooling holes 18 can improve film cooling of combustion liner 10.

Discussion of Possible Embodiments

The following are non-exclusive descriptions of possible embodiments of the present invention.

Some embodiments are related to a combustion liner with a plurality of cooling holes. The combustion liner includes a base-alloy substrate having a bottom surface and a top surface, a thermal barrier coat (TBC) metallic layer on the top surface of the base-alloy structure, and a TBC ceramic layer on the TBC metallic layer. The TBC ceramic layer has a top surface configured to be exposed to combustion gases during operation within a gas turbine engine. The plurality of cooling holes is formed, each through the combustion liner extending from an entrance aperture at the bottom surface of the base-alloy structure and an exit aperture at the top surface of the TBC ceramic layer. Each of the plurality of cooling holes is formed at an oblique angle to the top surface of the TBC ceramic layer, thereby forming an oval-characteristic exit aperture at the top surface of the TBC ceramic layer. Each of the oval-characteristic exit apertures defines a long axis and a short axis. The long axis extends between an upstream side and a downstream side and the short axis extends between opposite lateral sides, thereby defining opposite lateral sidewalls in each of the base-alloy substrate, the TBC metallic layer, and the TBC ceramic layer. Each of the cooling holes has a stepped sidewall profile at each of the opposite lateral sidewalls. A first distance between the opposite lateral sidewall of the TBC ceramic layer is greater than a second distance between the opposite lateral sidewalls of the TBC metallic layer.

The combustion liner of the preceding paragraph can optionally include, additionally and/or alternatively, any one or more of the following features, configurations and/or additional components:

A further embodiment of the foregoing combustion liner, wherein the stepped sidewall profile can include an exposed metallic ledge as viewed from the exit aperture.

A further embodiment of any of the foregoing combustion liners, wherein the first distance between the opposite lateral sidewalls of the TBC ceramic layer can be greater than a third distance between the opposite lateral sidewalls of the base-alloy substrate.

A further embodiment of any of the foregoing combustion liners, wherein the metallic ledge can be an exposed surface of the TBC metallic layer.

A further embodiment of any of the foregoing combustion liners, wherein the metallic ledge has a lateral ledge width, as measured in the direction of the short axis, that can be between 5% and 40% of the first distance between the opposite lateral sidewalls of the TBC ceramic layer at a TBC interface between the TBC metallic layer and the TBC ceramic layer.

A further embodiment of any of the foregoing combustion liners, wherein the metallic ledge has a lateral ledge width, as measured in the direction of the short axis, that can be between 10% and 30% of the first distance between the opposite lateral sidewalls of the TBC ceramic layer at a TBC interface between the TBC metallic layer and the TBC ceramic layer.

A further embodiment of any of the foregoing combustion liners, wherein the portion of the stepped sidewall profile corresponding to the TBC ceramic layer can be conic shaped or bell shaped, with the distance between sidewalls of the thermal barrier coating monotonically increasing as measured from a TBC interface between the TBC metallic layer and the TBC ceramic layer to the top surface of the TBC ceramic layer.

A further embodiment of any of the foregoing combustion liners, wherein a ratio of a first width between the opposite lateral sidewalls of the TBC ceramic layer, as measured at the TBC interface, to a second width between the opposite lateral sidewalls of the base-alloy substrate, can be greater than 1.1.

A further embodiment of any of the foregoing combustion liners, wherein a ratio of the first width between the opposite lateral sidewalls of the TBC ceramic layer, as measured at the TBC interface, to the second width between the opposite lateral sidewalls of the base-alloy substrate, can be greater than 1.2.

Some embodiments relate to a method for creating a combustion liner. In the method, a base-alloy substrate having a bottom surface and a top surface is provided. A thermal barrier coat (TBC) metallic layer is deposited on the top surface of the base-alloy structure. A TBC ceramic layer is deposited on the TBC metallic layer. The TBC ceramic layer has a top surface configured to be exposed to combustion gases during operation within a gas turbine engine. A plurality of cooling holes is formed through the combustion liner, each extending from an entrance aperture at the bottom surface of the base-alloy structure and an exit aperture at the top surface of the TBC ceramic layer. Each of the plurality of cooling holes is formed at an oblique angles to the top surface of the TBC ceramic layer, thereby forming an oval-characteristic exit aperture at the top surface of the TBC ceramic layer. Each of the oval-characteristic exit apertures defines a long axis and a short axis. The long axis extends between an upstream side and a downstream side, and the short axis extends between opposite lateral sides, thereby defining opposite lateral sidewalls in each of the base-alloy substrate, the TBC metallic layer, and the TBC ceramic layer. Each of the cooling holes has a stepped sidewall profile at each of the opposite lateral sidewalls. A first distance between the opposite lateral sidewalls of the TBC ceramic layer is greater than a second distance between the opposite lateral sidewalls of the TBC metallic layer.

The method of the preceding paragraph can optionally include, additionally and/or alternatively, any one or more of the following features, configurations and/or additional steps:

A further embodiment of the foregoing method, wherein drilling the plurality of cooling holes can be performed by a waterjet hole drill.

A further embodiment of any of the foregoing methods, wherein the waterjet hole drill can be configured to preferentially erode the TBC ceramic layer over the base-alloy substrate.

A further embodiment of any of the foregoing methods, wherein the waterjet hole drill can be configured to preferentially erode the TBC ceramic layer over the TBC metallic layer.

A further embodiment of any of the foregoing methods, wherein the stepped sidewall profile can include an exposed metallic ledge as viewed from the exit aperture.

A further embodiment of any of the foregoing methods, wherein the first distance between the opposite lateral sidewalls of the TBC ceramic layer can be greater than a third distance between the opposite lateral sidewalls of the base-alloy substrate.

A further embodiment of any of the foregoing methods, wherein the metallic ledge can be an exposed surface of the TBC metallic layer.

A further embodiment of any of the foregoing methods, wherein the metallic ledge has a lateral ledge width, as measured in the direction of the short axis, that can be between 5% and 40% of the first distance between the opposite lateral sidewalls of the TBC ceramic layer at a TBC interface between the TBC metallic layer and the TBC ceramic layer.

A further embodiment of any of the foregoing methods, wherein the metallic ledge has a lateral ledge width, as measured in the direction of the short axis, that can be between 10% and 30% of the first distance between the opposite lateral sidewalls of the TBC ceramic layer at a TBC interface between the TBC metallic layer and the TBC ceramic layer.

A further embodiment of any of the foregoing methods, wherein the portion of the stepped sidewall profile corresponding to the TBC ceramic layer can be conic shaped or bell shaped, with the distance between sidewalls of the thermal barrier coating monotonically increasing as measured from a TBC interface between the TBC metallic layer and the TBC ceramic layer to the top surface of the TBC ceramic layer.

A further embodiment of any of the foregoing methods, wherein a ratio of a first width between the opposite lateral sidewalls of the TBC ceramic layer, as measured at the TBC interface, to a second width between the opposite lateral sidewalls of the base-alloy substrate, can be greater than 1.1.

It will be recognized that the invention is not limited to the implementations described, but can be practiced with modification and alteration without departing from the scope of the appended claims. For example, the above implementations may include specific combination of features. However, the above implementations are not limited in this regard and, in various implementations, the above implementations may include the undertaking only a subset of such features, undertaking a different order of such features, undertaking a different combination of such features, and/or undertaking additional features than those features explicitly listed. The scope of the invention should, therefore, be determined with reference to the appended claims, along with the full scope of equivalents to which such claims are entitled.

The invention claimed is:

1. A combustion liner comprising:

a base-alloy substrate having a bottom surface and a top surface;

a thermal barrier coat (TBC) metallic layer on the top surface of the base-alloy substrate;

a TBC ceramic layer on the TBC metallic layer, thereby forming a TBC interface therebetween, the TBC ceramic layer having a top surface exposed to combustion gases during operation within a gas turbine engine; and a plurality of cooling holes, each extending from an entrance aperture at the bottom surface of the base-alloy substrate and an oval-characteristic exit aperture at the top surface of the TBC ceramic layer, each of the plurality of cooling holes formed at an oblique angle to the top surface of the TBC ceramic layer, thereby forming the oval-characteristic exit aperture at the top surface of the TBC ceramic layer, the oval-characteristic exit aperture defining a long axis and a short axis, the long axis extending between an upstream side and a downstream side and the short axis extending between opposite lateral sides, thereby defining upstream and downstream sidewalls and opposite lateral sidewalls in each of the base-alloy substrate, the TBC metallic layer, and the TBC ceramic layer, wherein each of the cooling holes has a stepped sidewall profile recessing the TBC ceramic layer from TBC metallic layer at each of the upstream and downstream sidewalls and the opposite lateral sidewalls, wherein, a first distance between the opposite lateral sidewall of the TBC ceramic layer is greater than a second distance between the opposite lateral sidewalls of the TBC metallic layer.

2. The combustion liner of claim 1, wherein the stepped sidewall profile includes an exposed top surface of the TBC metallic layer, thereby forming an exposed metallic ledge as viewed from the exit aperture.

3. The combustion liner of claim 2, wherein the first distance between the opposite lateral sidewalls of the TBC ceramic layer is greater than a third distance between the opposite lateral sidewalls of the base-alloy substrate.

4. The combustion liner of claim 3, wherein the metallic ledge is an exposed surface of the TBC metallic layer.

5. The combustion liner of claim 2, wherein the metallic ledge has a lateral ledge width, as measured in the direction of the short axis, that is between 5% and 40% of the first distance between the opposite lateral sidewalls of the TBC ceramic layer at the TBC interface.

6. The combustion liner of claim 5, wherein the lateral ledge width, as measured in the direction of the short axis, that is between 10% and 30% of the first distance between the opposite lateral sidewalls of the TBC ceramic layer at the TBC interface between the TBC metallic layer and the TBC ceramic layer.

7. The combustion liner of claim 1, wherein a portion of the stepped sidewall profile corresponding to the TBC ceramic layer is conic shaped or bell shaped, with the distance between the opposite lateral sidewalls of the TBC ceramic layer monotonically increasing as measured from the TBC interface to the top surface of the TBC ceramic layer.

8. The combustion liner of claim 7, wherein a ratio of a first width between the opposite lateral sidewalls of the TBC ceramic layer, as measured at the TBC interface, to a second width between the opposite lateral sidewalls of the base-alloy substrate, is greater than 1.1.

9. The combustion liner of claim 8, wherein a ratio of the first width between the opposite lateral sidewalls of the TBC ceramic layer, as measured at the TBC interface, to the second width between the opposite lateral sidewalls of the base-alloy substrate, is greater than 1.2.

10. A method for creating a combustion liner, the method comprising:

providing a base-alloy substrate having a bottom surface and a top surface;

depositing a thermal barrier coat (TBC) metallic layer on the top surface of the base-alloy substrate;

depositing a TBC ceramic layer on the TBC metallic layer, thereby forming a TBC interface therebetween, the TBC ceramic layer having a top surface exposed to combustion gases during operation within a gas turbine engine; and forming a plurality of cooling holes, each extending from an entrance aperture at the bottom surface of the base-alloy substrate and an oval-characteristic exit aperture at the top surface of the TBC ceramic layer, each of the plurality of cooling holes formed at an oblique angles to the top surface of the TBC ceramic layer, thereby forming the oval-characteristic exit aperture at the top surface of the TBC ceramic layer, the oval-characteristic exit aperture defining a long axis and a short axis, the long axis extending between an upstream side and a downstream side and the short axis extending between opposite lateral sides, thereby defining upstream and downstream sidewalls and opposite lateral sidewalls in each of the base-alloy substrate, the TBC metallic layer, and the TBC ceramic layer, wherein each of the cooling holes has a stepped sidewall profile recessing the TBC ceramic layer from TBC metallic layer at each of the upstream and downstream sidewalls and the opposite lateral sidewalls, wherein a first distance between the opposite lateral sidewalls of the TBC ceramic layer is greater than a second distance between the opposite lateral sidewalls of the TBC metallic layer.

11. The method of claim 10, wherein drilling the plurality of cooling holes is performed by a waterjet hole drill.

12. The method of claim 11, wherein the waterjet hole drill is configured to erode more the TBC ceramic layer than the base-alloy substrate.

13. The method of claim 11, wherein the waterjet hole drill is configured to erode more the TBC ceramic layer than the TBC metallic layer.

14. The method of claim 10, wherein the stepped sidewall profile includes an exposed top surface of the TBC metallic layer, thereby forming an exposed metallic ledge as viewed from the exit aperture.

15. The method of claim 14, wherein the first distance between the opposite lateral sidewalls of the TBC ceramic layer is greater than a third distance between the opposite lateral sidewalls of the base-alloy substrate.

16. The method of claim 15, wherein the metallic ledge is an exposed surface of the TBC metallic layer.

17. The method of claim 14, wherein the metallic ledge has a width, as measured in the direction of the short axis, that is between 5% and 40% of the first distance between the opposite lateral sidewalls of the TBC ceramic layer at the TBC interface.

18. The combustion liner of claim 14, wherein the metallic ledge has a width, as measured in the direction of the short axis, that is between 5% and 20% of the second distance between the opposite lateral sidewalls of the base-alloy substrate.

19. The combustion liner of claim 10, wherein a portion of the stepped sidewall profile corresponding to the TBC ceramic layer is conic shaped or bell shaped, with the distance between the opposite lateral sidewalls of the TBC ceramic layer monotonically increasing as measured from the TBC interface to the top surface of the TBC ceramic layer.

20. The method of claim 19, wherein a ratio of a first width between the opposite lateral sidewalls of the TBC ceramic layer, as measured at the TBC interface, to a second width between the opposite lateral sidewalls of the base-alloy substrate, is greater than 1.1.

* * * * *